US008122941B2

(12) United States Patent
Kim et al.

(10) Patent No.: US 8,122,941 B2
(45) Date of Patent: Feb. 28, 2012

(54) ALUMINUM ALLOY FOR VEHICLE CYLINDER LINER AND METHOD OF MANUFACTURING VEHICLE CYLINDER LINER USING THE SAME

(75) Inventors: Young Gi Kim, Gyeonggi-do (KR); Seok Jun Kim, Seoul (KR); Hoon Mo Park, Gyeonggi-do (KR)

(73) Assignees: Hyundai Motor Company, Seoul (KR); Kia Motors Corporation, Seoul (KR)

( * ) Notice: Subject to any disclaimer, the term of this patent is extended or adjusted under 35 U.S.C. 154(b) by 0 days.

(21) Appl. No.: 12/631,925

(22) Filed: Dec. 7, 2009

(65) Prior Publication Data

US 2010/0326619 A1 Dec. 30, 2010

(30) Foreign Application Priority Data

Jun. 30, 2009 (KR) ..... 10-2009-0059372

(51) Int. Cl.
*B22D 11/10* (2006.01)
*B22D 11/07* (2006.01)
*B22D 46/00* (2006.01)

(52) U.S. Cl. ..... 164/473; 164/4.1; 164/451; 164/472

(58) Field of Classification Search ..... 164/4.1, 164/113, 451, 472, 473
See application file for complete search history.

(56) References Cited

U.S. PATENT DOCUMENTS 5,250,125 A * 10/1993 Koch et al. ..... 148/549
5,303,682 A * 4/1994 Donahue et al. ..... 123/193.1
5,462,108 A * 10/1995 Katoh et al. ..... 164/98
5,891,273 A * 4/1999 Ruckert et al. ..... 148/523
2005/0043189 A1* 2/2005 Stewart et al. ..... 508/112
2010/0162886 A1* 7/2010 Choi et al. ..... 92/169.4
2010/0243191 A1* 9/2010 Nishikawa ..... 164/4.1

FOREIGN PATENT DOCUMENTS

JP 59215261 A * 12/1984
JP 2006150395 A * 6/2006
KR 2008014359 A * 2/2008
KR 836309 B1 * 6/2008

* cited by examiner

*Primary Examiner* — Jessica L Ward
*Assistant Examiner* — Devang R Patel
(74) *Attorney, Agent, or Firm* — Edwards Wildman Palmer LLP; Peter F. Corless

(57) ABSTRACT

The present invention is directed to an aluminum alloy including aluminum as a basic component, silicon, copper, magnesium, iron, manganese, zinc, nickel and the like in a predetermined composition ratio, and a method of manufacturing of a vehicle cylinder liner having excellent wear resistance and heat resistance using the aluminum alloy.

The method of manufacturing a vehicle cylinder liner includes the steps of: adding 50~500 ppm of phosphorus (P) to the aluminum alloy while maintaining a temperature of the aluminum alloy at 700~800° C. in a holding furnace, stabilizing the molten aluminum alloy including the phosphorus (P) for 30~60 minutes to reform the molten aluminum alloy, and then continuous-casting the reformed molten aluminum alloy to form a round bar; hot-forging the round bar to forming a cylindrical liner; and machining an internal surface of the cylinder liner, with which a reciprocating piston comes into contact, to allow silicon particles to protrude.

7 Claims, 3 Drawing Sheets

[FIG. 1]
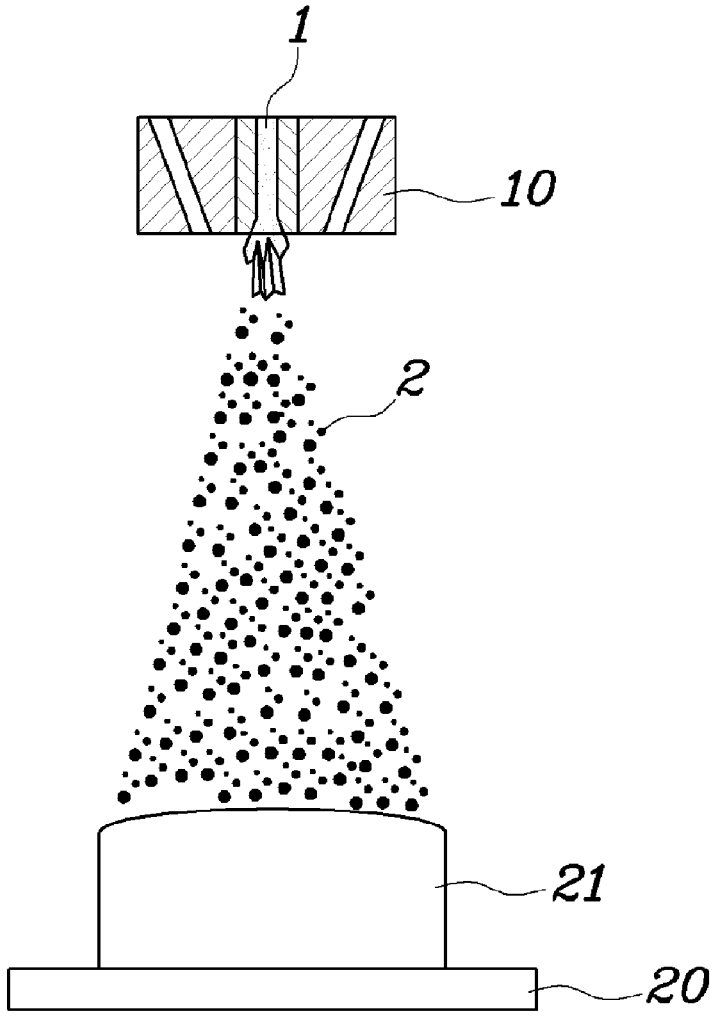
PRIOR ART

[FIG. 2]
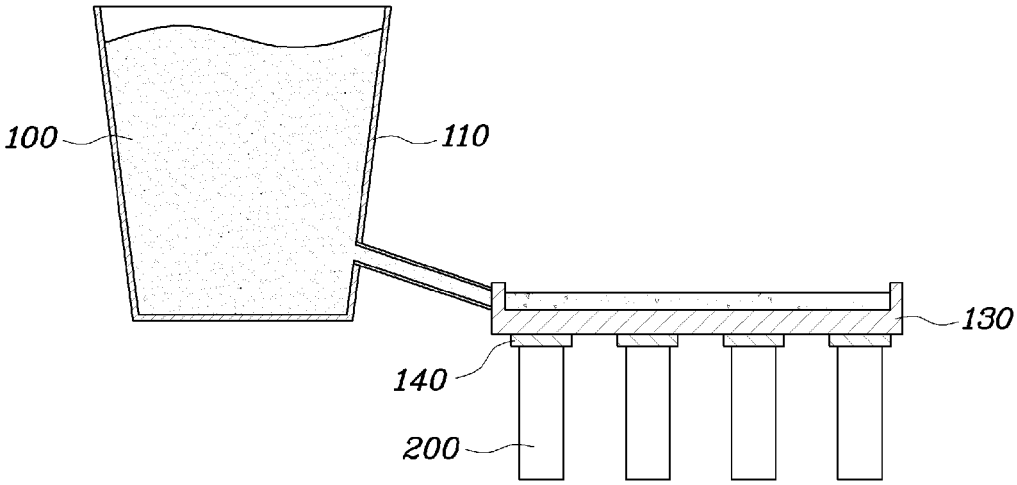

[FIG. 3]
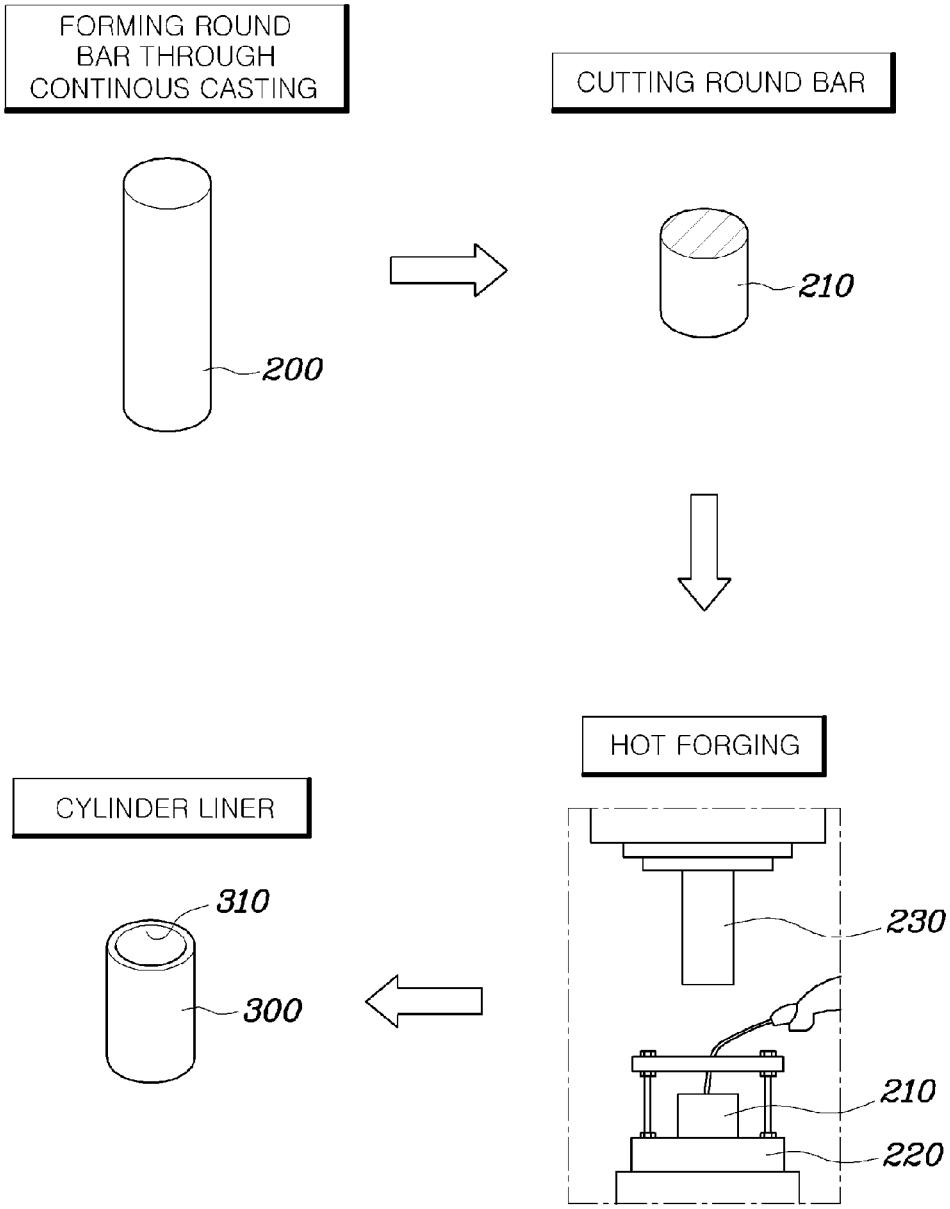

ALUMINUM ALLOY FOR VEHICLE CYLINDER LINER AND METHOD OF MANUFACTURING VEHICLE CYLINDER LINER USING THE SAME

CROSS-REFERENCE TO RELATED APPLICATIONS

This application claims under 35 U.S.C. §119(a) priority to Korean Application No. 10-2009-0059372, filed on Jun. 30, 2009, the disclosure of which is incorporated herein by reference in its entirety.

BACKGROUND OF THE INVENTION

1. Field of the Invention

The present invention relates, in general, to an aluminum alloy for a vehicle cylinder liner and a method of manufacturing a cylinder liner using the same.

Generally, a cylinder liner is fitted into a bore of an engine block, and serves to suitably prevent the bore from becoming abraded during the reciprocation of a piston. Currently, a cylinder liner, which is used to reinforce the bore of an aluminum cylinder block and adapted to suit the trend of decreasing the weight of engines for transport machines such as automobiles and the like, is mainly made of cast iron.

Recently, a cylinder liner made of aluminum extrusion has been used in an effort to improve the cooling performance of an engine and decrease the weight of an engine in accordance with the development of high-powered engines. Accordingly, the cylinder liner needs wear resistance. Therefore, in order to suitably improve the wear resistance of the cylinder liner, the amount of silicon included in an aluminum alloy is increased, and the size of silicon is miniaturized.

FIG. 1 is a schematic view showing an exemplary conventional method of manufacturing an aluminum cylinder liner using a spray forming method.

Conventionally, a spray forming method is used in order to suitably increase the amount of silicon included in a cylinder liner and miniaturize the size of silicon. In the spray forming method, a molten metal 1 (for example, molten aluminum) is rapidly cooled using high-speed high-pressure inert gases and then sprayed through a sprayer 10 to be formed into droplets 2. The droplets 2 drop in the air are in a state of incomplete solidification, and then are completely solidified after they reach a substrate 20, thus forming a round bar 21.

Subsequently, the round bar 21 formed using the spray forming method is manufactured into a cylinder liner through indirect extrusion (hot extrusion) and then swaging and then cutting and working and then surface treatment.

However, as described above, in the conventional method of manufacturing an aluminum cylinder liner using a spray forming method the size of silicon can be miniaturized; however, at the same time the process of forming a round bar is complicated, and the formed round bar must be further extruded, thus increasing the production cost thereof.

Further, in the conventional method material loss occurs when holes are formed in the inner surface of a round bar in order to suitably conduct seamless extrusion at the time of the extrusion of the round bar.

Further, the conventional cylinder liner manufactured using the spray forming method is also problematic in that particles are too small in size, so that it is not easy to perform a machining process, and so a chemical etching process is used in order to allow hard particles to protrude, thereby causing environmental pollution.

SUMMARY OF THE INVENTION

In preferred aspects, the present invention provides an aluminum alloy having suitably strong wear resistance or an aluminum alloy having suitably excellent heat resistance as well as suitably excellent wear resistance.

Another preferred embodiment of the present invention provides a method of manufacturing a cylinder liner using the aluminum alloy at low cost and a suitably simple manufacturing process.

Preferably, in order to accomplish the above objects, a preferred embodiment of the present invention provides an aluminum alloy for a vehicle cylinder liner, preferably including: aluminum as a basic component; silicon (Si): 16~22 wt %; copper (Cu): 2~6 wt %; magnesium (Mg): 0.2~2.0 wt %; iron (Fe): 1 wt % or less; manganese (Mn): 0.1 wt % or less; zinc (Zn): 0.1 wt % or less; and nickel (Ni): 0.1 wt % or less.

Another preferred embodiment of the present invention provides an aluminum alloy for a vehicle cylinder liner, preferably including: aluminum as a basic component; silicon (Si): 16~22 wt %; copper (Cu): 2~6 wt %; magnesium (Mg): 0.2~4.0 wt %; iron (Fe): 1 wt % or less; nickel (Ni): 1~5 wt %; manganese (Mn): 0.1 wt % or less; and zinc (Zn): 0.1 wt % or less.

In another preferred embodiment, the present invention provides a method of manufacturing a cylinder liner for a vehicle, preferably including the steps of: adding 50~500 ppm of phosphorus (P) to the aluminum alloy while maintaining a temperature of the aluminum alloy at 700~800° C. in a holding furnace, stabilizing the molten aluminum alloy including the phosphorus (P) for 30~60 minutes to reform the molten aluminum alloy, and then continuous-casting the reformed molten aluminum alloy to form a round bar; hot-forging the round bar to forming a cylindrical liner; and machining an internal surface of the cylindrical liner, with which a reciprocating piston comes into contact, to allow silicon particles to protrude.

Preferably, in the method, the step of continuous-casting the reformed molten aluminum alloy to form the round bar may include the step of suitably transferring the molten aluminum alloy from the holding furnace to a cast connected to a mold, wherein oxygen and nitrogen gases are suitably supplied to an inner wall of the mold at a pressure of 7~15 $kg/cm^2$ and a lubricant is supplied thereto at a flow rate of 5~10 cc/min such that the molten aluminum alloy is solidified while not being adhered to the inner wall of the mold, and a cooling zone having a cooling rate of 30~60 liter/min is formed in the mold to control a molding speed of the molten aluminum alloy at 80~120 mm/min.

In further preferred embodiments, in the step of forming the cylinder liner, the round bar formed through the continuous casting may be cut to a predetermined length, heated to a temperature of 350~450° C., and then suitably pressed to form the cylinder liner.

Preferably, in the step of machining the surface of the cylinder liner, the internal surface of the cylinder liner, with which a reciprocation piston comes into suitable contact, is machined, bored to adjust its size uniformly, and then suitably honed to allow silicon particles to protrude.

According to certain preferred embodiments of the present invention, the step of honing the bored cylinder liner may preferably include the steps of: grounding a workpiece by 40~80 μm using a diamond stone having a particle size of 46~60 μm; grounding the workpiece by 20~40 μm using a diamond stone or ceramic stone having a particle size of 15~25 μm; and grounding the workpiece by 1~5 μm using a ceramic stone having a particle size of 15~25 μm, wherein the resulting cylinder liner has a surface roughness of Rz=1~3 μm and Rpk=0.4~0.8 μm.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, plug-in hybrid electric vehicles, hydrogen-powered vehicles and other alternative fuel vehicles (e.g. fuels derived from resources other than petroleum).

As referred to herein, a hybrid vehicle is a vehicle that has two or more sources of power, for example both gasoline-powered and electric-powered.

The above features and advantages of the present invention will be apparent from or are set forth in more detail in the accompanying drawings, which are incorporated in and form a part of this specification, and the following Detailed Description, which together serve to explain by way of example the principles of the present invention.

BRIEF DESCRIPTION OF THE DRAWINGS

The above and other objects, features and advantages of the present invention will be more clearly understood from the following detailed description taken in conjunction with the accompanying drawings, in which:

FIG. 1 is an exemplary schematic view showing a conventional method of manufacturing a cylinder liner using a spray forming method;

FIG. 2 is an exemplary schematic view showing a process of forming a round bar using continuous casting according to an embodiment of the present invention; and FIG. 3 is an exemplary schematic view explaining a process of manufacturing the round bar into a cylinder liner through hot forging.

DESCRIPTION OF THE PREFERRED EMBODIMENTS

As described herein, the present invention includes, in one aspect, an aluminum alloy for a vehicle cylinder liner, comprising aluminum as a basic component, silicon (Si): 16~22 wt %; copper (Cu): 2~6 wt %; magnesium (Mg): 0.2~2.0 wt %; iron (Fe): 1 wt % or less; manganese (Mn): 0.1 wt % or less; zinc (Zn): 0.1 wt % or less; and nickel (Ni): 0.1 wt % or less.

In another aspect, the invention features an aluminum alloy for a vehicle cylinder liner, comprising aluminum as a basic component, silicon (Si): 16~22 wt %; copper (Cu): 2~6 wt %; magnesium (Mg): 0.2~4.0 wt %; iron (Fe): 1 wt % or less; nickel (Ni): 1~5 wt %; manganese (Mn): 0.1 wt % or less; and zinc (Zn): 0.1 wt % or less.

In another aspect, the invention features a method of manufacturing a cylinder liner for a vehicle, comprising the steps of adding 50~500 ppm of phosphorus (P) to the aluminum alloy of any one of the aspects or embodiments described herein, stabilizing the molten aluminum alloy including the phosphorus (P), and then continuous-casting the reformed molten aluminum alloy to form a round bar, hot-forging the round bar to forming a cylindrical liner; and machining an internal surface of the cylindrical liner.

In one embodiment, 50~500 ppm of phosphorus (P) is added to the aluminum alloy while maintaining a temperature of the aluminum alloy at 700~800° C. in a holding furnace.

In another embodiment, the molten aluminum alloy including the phosphorus (P) is stabilized for 30~60 minutes to reform the molten aluminum alloy, and then continuous-casting the reformed molten aluminum alloy to form a round bar.

In a further embodiment, a reciprocating piston comes into contact with the internal surface of the cylindrical liner, to allow silicon particles to protrude.

The invention also features a motor vehicle comprising the aluminum alloy for a vehicle cylinder liner as described in any one of the embodiments herein. Hereinafter, preferred embodiments of the present invention will be described in detail with reference to the attached drawings.

FIG. 2 is a schematic view showing a process of forming a round bar using continuous casting according to a preferred embodiment of the present invention. FIG. 3 is a schematic view illustrating a process of manufacturing the round bar into a cylinder liner through hot forging according to a preferred embodiment of the present invention.

Preferably, according to preferred embodiments of the present invention, the embodiments of an aluminum alloy used to manufacture a cylinder liner for a vehicle are as follows.

Preferably, an aluminum alloy according to a first embodiment of the present invention includes: aluminum as a basic component; silicon (Si): 16~22 wt %; copper (Cu): 2~6 wt %; magnesium (Mg): 0.2~2.0 wt %; iron (Fe): 1 wt % or less; manganese (Mn): 0.1 wt % or less; zinc (Zn): 0.1 wt % or less; and nickel (Ni): 0.1 wt % or less. The aluminum alloy according to the first embodiment of the present invention is used to manufacture a general cylinder liner.

Preferably, an aluminum alloy according to a second embodiment of the present invention includes: aluminum as a basic component; silicon (Si): 16~22 wt %; copper (Cu): 2~6 wt %; magnesium (Mg): 0.2~4.0 wt %; iron (Fe): 1 wt % or less; nickel (Ni): 1~5 wt %; manganese (Mn): 0.1 wt % or less; and zinc (Zn): 0.1 wt % or less. The aluminum alloy according to the second embodiment of the present invention is similar to the aluminum alloy according to the first embodiment of the present invention in components, but has higher magnesium (Mg) and nickel (Ni) contents than those of the aluminum alloy according to the first embodiment of the present invention in order to improve the heat resistance of a cylinder liner. Therefore, the aluminum alloy according to the second embodiment of the present invention is used to manufacture a cylinder liner requiring heat resistance.

Preferably, in the aluminum alloys according to the first and second embodiments of the present invention, silicon (Si) is used in an amount of 16~22 wt %. In certain preferred embodiments, when the amount of silicon is less than 16 wt %, the amount of primary crystal of silicon is too small, thus deteriorating wear resistance. In other preferred embodiments, when the amount of silicon is more than 22 wt % and thus an excess amount of silicon is used, the microsegregation and coarsening of silicon particles occur during a continuous casting process, thus deteriorating wear resistance and workability. Silicon is effective in the improvement of wear resistance, castability and strength.

According to certain exemplary embodiments, copper (Cu) is used in an amount of 2~6 wt %.

Preferably, when the amount of copper is less than 2 wt %, there is no solid solution hardening effect. In other preferred embodiments, when the amount of copper is more than 6 wt % and thus an excess amount of copper is used, there the solid solubility of copper is suitably limited.

In certain preferred embodiments, the amount of magnesium (Mg) in the first embodiment of the present invention is 0.2~2.0 wt %, and the amount of magnesium (Mg) in the second embodiment of the present invention is 0.2~4.0 wt %. Preferably, when the amount of magnesium (Mg) increases in this range, the heat resistance of a cylinder liner is suitably improved.

Accordingly, when the amount of magnesium (Mg) is less than 0.2 wt %, the strength of a cylinder liner is suitably decreased. In other preferred embodiments, when the amount of magnesium is more than 4.0 wt % and thus an excess amount of magnesium is used, the castability of an aluminum alloy is suitably deteriorated. Preferably, magnesium is formed into a precipitate together with silicon, thus improving the strength of a cylinder liner.

In further preferred embodiments, when the amount of iron (Fe) is more than 1 wt %, the elongation rate of a cylinder liner is suitably decreased.

Manganese (Mn), zinc (Zn) and nickel (Ni) are elements present in trace amounts. In one preferred embodiment of the present invention, manganese, zinc and nickel are added in amounts of 0.1 wt % or less, respectively. In a second preferred embodiment of the present invention, manganese and zinc are respectively added in an amount of 0.1 wt % or less, which is the same as those of the first embodiment of the present invention, but nickel is added in an amount of 1~5 wt %, which is higher than that of the first embodiment of the present invention. In a second preferred embodiment of the present invention, the amount of nickel is suitably increased in order to increase the heat resistance of a cylinder liner.

According to a further preferred embodiments of the present invention, in order to manufacture a cylinder liner for a vehicle using the aluminum alloys according to the first and second embodiments of the present invention described herein, each of the aluminum alloys is preferably formed into a molten aluminum alloy by suitably overheating it to a melting point or higher and thus melting it.

In a further preferred embodiment, since when using aluminum alloy it is difficult to control the size and distribution of primary crystal of silicon when using a general casting method, it is not preferably used as a raw material of a cylinder liner for a vehicle. Accordingly, in further preferred embodiments, in order to use the aluminum alloy to suitably manufacture a cylinder liner for a vehicle, silicon included in a solid solution alloy must be uniformly crystallized and precipitated to be minutely distributed in a matrix. Accordingly, a continuous casting method, in which the molten aluminum alloy can be suitably reformed by the addition of phosphorus (P) and can be uniformly cooled rapidly, is required.

According to further preferred embodiments of the invention, and as shown in FIG. 2, a molten aluminum alloy 100 according to the first or second embodiment of the present invention is suitably reformed by adding 50~500 ppm of phosphorus (P) to the molten aluminum alloy 100 while suitably maintaining the temperature of the molten aluminum alloy 100 at 700~800° C. in a holding furnace 110 and then suitably stabilizing the molten aluminum alloy including the phosphorus (P) for 30~60 minutes. Preferably, when the content of calcium is suitably maintained at less than 50 ppm, the molten aluminum alloy 100 can be more effectively reformed.

According to further preferred embodiments, this reformed molten aluminum alloy 100 is suitably formed into a round bar 200 using a continuous casting method (step of forming a round bar using continuous casting).

In further preferred embodiments, the continuous casting method is a casting method in which a molten metal 100 (molten aluminum alloy) is continuously introduced into a mold 130 and solidified, and is generally used to fabricate round bars having various shapes such as, but not limited to, that of a plate, a rod and the like.

Preferably, in the continuous casting method, the molten metal 100, which is positioned above the mold 130, is continuously introduced into the mold 130 and is allowed to be partially discharged downward through holes formed at the bottom of the mold 130. Subsequently, in further preferred embodiments, protrusions of the molten metal 100, which are partially solidified, are continuously drawn downward while being rapidly cooled using cooling water, thus suitably providing long round bars having lengths of several meters to several tens meters.

In further preferred embodiments, for example in the case of fabricating the round bar 200 using the continuous casting method, it is necessarily required to control the temperatures of the mold 130 and dies 140 at the time of solidifying the molten aluminum alloy (Al—Si—Mg—Cu). Preferably, the step of forming the round bar 200 using the continuous casting includes a step of suitably transferring the molten aluminum alloy 100 from the holding furnace 110 to the mold 130 connected to the dies 140. According to further preferred embodiments, when the molten aluminum alloy 100 is suitably charged in the mold 130, the temperature of the inlet of the mold 130 is suitably maintained at 650° C. or more to prevent the molten aluminum alloy from rapidly cooling and thus solidifying at the side wall of the mold 130.

In further preferred embodiments, oxygen and nitrogen gases are suitably supplied to the inner wall of the die 140 at a pressure of 7~15 $kg_f/cm^2$ and a lubricant is suitably supplied thereto at a flow rate of 5~10 cc/min such that the molten aluminum alloy is solidified while not becoming adhered to the inner wall of the die 140, and a cooling zone having a cooling rate of 30~60 liter/min is formed in the die 140 to control a molding speed of the molten aluminum alloy to 80~120 mm/min.

Preferably, the above condition is an essential condition that is required to allow the molten aluminum alloy 100 continuously supplied to the upper part of the mold 130 not to directly flow down and to suitably maintain its billet shape. According to further preferred embodiments, the molten aluminum alloy 100 suitably discharged from the mold 140 is continuously formed into the round bar 200 through the cooling zone of the die 140 by suitably controlling the molding speed of the molten aluminum alloy to 80~120 mm/min.

Subsequently, the round bar 200 preferably fabricated through continuous casting is suitably formed into a cylindrical (pipe shape) liner through hot forging.

Preferably, in the conventional spray forming method, a workpiece, such as a round bar, is suitably extruded into a cylindrical liner through seamless extrusion. Preferably, since holes must be formed in the middle part of the workpiece in order to conduct the seamless extrusion, the loss of the workpiece occurs, and processes become complicated.

Preferably, in the present invention, the cylindrical liner is suitably manufactured using hot forging instead of seamless extrusion.

According to certain preferred embodiments and as shown in FIG. 3, in the step of forming the cylindrical liner through hot forging, the round bar 100 formed through the continuous casting is cut to a predetermined length in accordance with the height of a liner to be formed, and then the cut round bar 210 is suitably heated to a temperature of 350~450° C. and then pressed to form the cylindrical liner.

In certain preferred embodiments, when the cut round bar 210 is hot-forged at a temperature of less than 350° C., forging cracks are suitably generated due to the embrittlement of the cut round bar 210. In other certain embodiments, when the cut round bar 210 is hot-forged at a temperature of more than 450° C., the cut round bar 210 cannot be formed into a suitably cylindrical liner due to the adhesion between a forging die and the cut round bar 210.

Preferably, in the hot forging, the heated round bar 210 is placed on a forging die 220 and then press-forged one stage using a press forging machine 230 to form a cylindrical liner 300.

In further preferred embodiments, the cylindrical liner 300 formed through the hot forging process is suitably inserted into a cylinder block, and then the internal surface of the cylindrical liner 300, with which a reciprocating piston comes into contact, is machined to allow silicon particles to protrude, thus forming an oil storage space and suitably improving wear resistance.

Preferably, in the step of machining the surface of the cylinder liner 300, the internal surface 310 of the cylinder liner, with which a reciprocating piston comes into suitable contact, is machined, bored to adjust its size uniformly, and then suitably honed to allow silicon particles to protrude.

In further exemplary embodiments, the process of honing the bored cylindrical liner 300 preferably includes the following three steps.

In a first preferred step, a workpiece is suitably ground by 40~80 μm using a diamond stone having a particle size of 46~60 μm. Preferably, this step may be performed under the conditions of a rotation speed of 150~350 rpm, a transfer speed of 8~20 m/min, one way rotation direction, and a machining time of 15~30 seconds.

In a second preferred step, the workpiece ground in the first step is further ground by 20~40 μm using a diamond stone or ceramic stone having a particle size of 15~25 μm.

In a third preferred step, the workpiece ground in the second step is further ground by 1~5 μm using a ceramic stone having a particle size of 15~25 μm. Preferably, this step may be performed under the conditions of a rotation speed of 150~350 rpm, a transfer speed of 8~20 m/min, two way rotation direction, i.e., repeated rotation between the clockwise direction and the counterclockwise direction, and a machining time of 15~40 seconds.

Through the honing process including the three steps, finally, a cylinder liner having a surface roughness of Rz=1~3 μm and Rpk=0.4~0.8 μm is suitably manufactured. Accordingly, in certain preferred embodiments, highly desirable engine test results can be obtained.

Preferably, when the surface roughness of the cylinder liner is below the aforementioned value, lubrication performance is suitably deteriorated. When the surface roughness thereof is above the aforementioned value, oil consumption is suitably increased.

As described herein, according to the present invention, a vehicle cylinder liner having excellent wear resistance and heat resistance can be suitably manufactured using an aluminum alloy including aluminum as a basic component, silicon, copper, magnesium, iron, manganese, zinc, nickel and the like in a predetermined composition ratio.

Further, according to methods of manufacturing a cylinder liner of the present invention as described herein, since a molten aluminum alloy is reformed and then formed into a round bar through continuous casting, silicon included in a solid solution alloy is uniformly crystallized and precipitated to be minutely distributed in a matrix, so that the oil storage capacity and wear resistance of a cylinder liner are suitably improved, thereby improving engine performance.

Further, according to methods of manufacturing a cylinder liner of the present invention as described herein, the production cost of a cylinder liner can be suitably reduced because a round bar is simply formed prior to the manufacture of the cylinder liner, and environmental pollution problems do not occur because chemical methods are not used in the manufacture of the cylinder liner.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of manufacturing a cylinder liner for a vehicle, comprising:

adding 50~500 ppm of phosphorus (P) to a molten aluminum alloy, wherein aluminum is a basic component in the molten aluminum alloy, stabilizing the molten aluminum alloy including the phosphorus (P), and then continuous-casting the reformed molten aluminum alloy to form a round bar by transferring the molten aluminum alloy from a holding furnace to a mold connected to dies, wherein oxygen and nitrogen gases are supplied to an inner wall of the die at a pressure of 7~15 $kg_f/cm^2$ and a lubricant is supplied thereto at a flow rate of 5~10 cc/min such that the molten aluminum alloy is solidified while not becoming adhered to the inner wall of the die, and wherein a cooling zone having a coolant rate of 30~60 liter/min is formed in the die to control a molding speed of the molten aluminum alloy to 80~120 mm/min;

hot-forging the round bar to forming a cylindrical liner; and machining an internal surface of the cylindrical liner.

2. The method of manufacturing a cylinder liner of claim 1, wherein 50~500 ppm of phosphorus (P) is added to the aluminum alloy while maintaining a temperature of the aluminum alloy at 700~800 ° C. in the holding furnace.

3. The method of manufacturing a cylinder liner of claim 2, wherein the molten aluminum alloy including the phosphorus (P) is stabilized for 30~60 minutes to reform the molten aluminum alloy, and then continuous-casting the reformed molten aluminum alloy to form a round bar.

4. The method of manufacturing a cylinder liner of claim 3, wherein a reciprocating piston comes into contact with the internal surface of the cylindrical liner, to allow silicon particles to protrude.

5. The method of manufacturing a cylinder liner for a vehicle according to claim 1, wherein, in the step of forming the cylinder liner, the round bar formed through the continuous casting is cut to a predetermined length, heated to a temperature of 350~450 ° C, and then pressed to form the cylinder liner.

6. The method of manufacturing a cylinder liner for a vehicle according to claim 5, wherein, in the step of machining the surface of the cylinder liner, the internal surface of the cylinder liner, with which a reciprocation piston comes into contact, is machined, bored to adjust its size uniformly, and then honed to allow silicon particles to protrude.

7. The method of manufacturing a cylinder liner for a vehicle according to claim 6. wherein the step of honing the bored cylinder liner comprises:

grounding a workpiece by 40~80 μm using a diamond stone having a particle size of 46~60 μm;

grounding the workpiece by 20~40 μm using a diamond stone or ceramic stone having a particle size of 15~25 μm; and grounding the workpiece by 1~5 μm using a ceramic stone having a particle size of 15~25 μm, wherein the resulting cylinder liner has a surface roughness of Rz =1~3 μm and Rpk =0.4~0.8 μm.

* * * * *